US010968591B2

(12) United States Patent
Gunter

(10) Patent No.: US 10,968,591 B2
(45) Date of Patent: Apr. 6, 2021

(54) PILE GUIDE COMPRISING A BASE FRAME AND A GUIDE MEMBER

(71) Applicant: IHC IQIP UK LTD., Dorset (GB)

(72) Inventor: David Howel Gunter, Poole (GB)

(73) Assignee: IHC IQIP UK LTD., Stickland (GB)

( * ) Notice: Subject to any disclaimer, the term of this patent is extended or adjusted under 35 U.S.C. 154(b) by 0 days.

(21) Appl. No.: 16/336,401

(22) PCT Filed: Sep. 27, 2017

(86) PCT No.: PCT/EP2017/074525
§ 371 (c)(1),
(2) Date: Mar. 25, 2019

(87) PCT Pub. No.: WO2018/060267
PCT Pub. Date: Apr. 5, 2018

(65) Prior Publication Data

US 2019/0218739 A1 Jul. 18, 2019

(30) Foreign Application Priority Data

Sep. 30, 2016 (NL) ..... 2017560

(51) Int. Cl.
*E02D 13/04* (2006.01)
*E02D 7/06* (2006.01)

(52) U.S. Cl.
CPC ..... *E02D 13/04* (2013.01); *E02D 7/06* (2013.01)

(58) Field of Classification Search
CPC ..... E02D 13/04; E02D 7/06
See application file for complete search history.

(56) References Cited

U.S. PATENT DOCUMENTS 1,762,037 A * 6/1930 Taylor ..... E21B 19/07 188/67
2,651,181 A 9/1953 Alcorn et al.
3,345,879 A 10/1967 Nasu et al.
3,595,182 A * 7/1971 Clapp ..... B27K 3/0235 111/118

(Continued)

FOREIGN PATENT DOCUMENTS

CN 1268202 A 9/2000
CN 202298623 U 7/2012

(Continued)

OTHER PUBLICATIONS

International Preliminary Report on Patentability for International application No. PCT/EP2017/074525, dated Apr. 11, 2019.

(Continued)

*Primary Examiner* — Tara Mayo-Pinnock
(74) *Attorney, Agent, or Firm* — Steven M. Koehler; Westman, Champlin & Koehler

(57) ABSTRACT

The invention relates to a pile guide comprising a base frame and a guide member for guiding a pile as it is driven into a substrate, the guide member comprising a plurality of guide parts that are movable between an operative position for supporting the pile and an inoperative position. The pile guide comprises a mechanism that couples the guide parts such that movement of a guide part towards the operative position results in movement of at least one other guide part towards the operative position.

20 Claims, 1 Drawing Sheet

(56) References Cited

U.S. PATENT DOCUMENTS

| | | | | |
|---|---|---|---|---|
| 3,827,508 | A | 8/1974 | MacKinnon | |
| 4,102,094 | A | 7/1978 | MacKinnon | |
| 4,127,991 | A | 12/1978 | Regan | |
| 4,154,552 | A | 5/1979 | van Bilderbeek | |
| 4,408,932 | A | 10/1983 | Cowan | |
| 4,697,959 | A * | 10/1987 | Kinnan | E04H 12/2292 175/394 |
| 4,822,212 | A | 4/1989 | Hall et al. | |
| 5,772,363 | A * | 6/1998 | Larson | E02D 9/005 111/101 |
| 6,234,260 | B1 | 5/2001 | Coast et al. | |
| 6,305,882 | B1 | 10/2001 | Coast et al. | |
| 6,354,767 | B1 | 3/2002 | Jones | |
| 6,447,036 | B1 * | 9/2002 | White | B66C 1/427 294/106 |
| 6,749,371 | B2 | 6/2004 | Jones | |
| 6,994,493 | B2 | 2/2006 | Jones | |
| 7,585,133 | B2 | 9/2009 | Jones | |
| 7,972,083 | B2 | 7/2011 | Jones | |
| 8,672,587 | B2 | 3/2014 | Mack et al. | |
| 8,801,334 | B2 | 8/2014 | Paulus et al. | |
| 8,950,977 | B2 | 2/2015 | Cruickshank | |
| 9,145,654 | B2 | 9/2015 | Berry et al. | |
| 9,328,477 | B2 | 5/2016 | Goodbourn et al. | |
| 9,605,400 | B2 | 3/2017 | Fraenkel et al. | |
| 2003/0077127 | A1 | 4/2003 | Jones | |
| 2005/0117976 | A1 | 6/2005 | Jones | |
| 2008/0025799 | A1 | 1/2008 | Kawasaki | |
| 2009/0129870 | A1 | 5/2009 | Jones | |
| 2009/0166092 | A1 | 7/2009 | Jones | |
| 2009/0252925 | A1 | 10/2009 | Provoost et al. | |
| 2011/0158752 | A1 | 6/2011 | Hitchin | |
| 2011/0211917 | A1 | 9/2011 | Jones | |
| 2011/0318113 | A1 | 12/2011 | Fraenkel | |
| 2012/0177447 | A1 | 7/2012 | Fraenkel et al. | |
| 2012/0301226 | A1 | 11/2012 | Mack et al. | |
| 2012/0315097 | A1 | 12/2012 | Paulus et al. | |
| 2013/0043211 | A1 | 2/2013 | Vermeulen | |
| 2013/0115007 | A1 | 5/2013 | Cruickshank | |
| 2014/0056649 | A1 | 2/2014 | Berry et al. | |
| 2014/0193209 | A1 | 7/2014 | Goodbourn et al. | |
| 2015/0284927 | A1 | 10/2015 | Gunter | |
| 2016/0002875 | A1 | 1/2016 | Gunter | |

FOREIGN PATENT DOCUMENTS

| | | | |
|---|---|---|---|
| CN | 202466592 | U | 10/2012 |
| EP | 1036886 | A1 | 9/2000 |
| EP | 1304415 | A1 | 4/2003 |
| EP | 2325398 | A1 | 5/2011 |
| EP | 2532790 | A1 | 12/2012 |
| EP | 2554725 | A2 | 2/2013 |
| GB | 2476823 | A | 7/2011 |
| JP | 58189423 | S | 11/1983 |
| JP | 60126427 | S | 7/1984 |
| WO | 9911872 | A1 | 3/1999 |
| WO | 0192645 | A2 | 12/2001 |
| WO | 03074795 | A1 | 9/2003 |
| WO | 2006109018 | A1 | 10/2006 |
| WO | 2007066078 | A1 | 6/2007 |
| WO | 2009024739 | A2 | 2/2009 |
| WO | 2010015799 | A2 | 2/2010 |
| WO | 2010043845 | A1 | 4/2010 |
| WO | 2010092351 | A1 | 8/2010 |
| WO | 2010112832 | A1 | 10/2010 |
| WO | 2011083324 | A1 | 7/2011 |
| WO | 2012143697 | A1 | 10/2012 |
| WO | 2013014416 | A1 | 1/2013 |
| WO | 2014057034 | A1 | 9/2014 |
| WO | 2014131886 | A1 | 9/2014 |

OTHER PUBLICATIONS

International Search Report dated Oct. 13, 2017 for corresponding International Application No. PCT/EP2017/074525, filed Sep. 27, 2017.

Written Opinion of the International Searching Authority dated Oct. 13, 2017 for corresponding International Application No. PCT/EP2017/074525, filed Sep. 27, 2017.

Screenshot from Youtube video entitled "IHC Hydrohammer: The Noise Mitigation System", dated Jan. 22, 2013. https://www.youtube.com/watch?v=x2ZS0khVfjk.

Brendan Casey and Marian Tumarkin, How to Synchronize Hydraulic Cylinders, published in 2006, p. 5.

Third Party Oppositions filed in EP 17771780.8, mailed Nov. 8, 2019.

First Office Action from the Chinese Patent Office for Chinese patent application No. 201780059993.1, dated Aug. 19, 2020, with English translation.

* cited by examiner

PILE GUIDE COMPRISING A BASE FRAME AND A GUIDE MEMBER

CROSS-REFERENCE TO RELATED APPLICATION

The present application is a national stage of and claims priority of International patent application Serial No. PCT/EP2017/074525, filed Sep. 27, 2017, and published in English as WO 2018/060267, the content of which is hereby incorporated by reference in its entirety.

BACKGROUND

The invention relates to a pile guide comprising a base frame and a guide member for guiding a pile as it is driven into a substrate when the base frame rests thereon, the guide member comprising a plurality of guide parts that are movable, e.g. pivotally mounted on the base frame, between an operative position for supporting the pile and an inoperative position.

Pile guides are known and used to support, level and orientate free-standing impact-driven piles on a ground formation, e.g. on a seabed for a variety of offshore projects, including FPSO and FSO moorings, single point moorings, riserbase piles and pipeline initiation piles, offshore loading systems, and conductors.

As explained in WO 99/11872, it is known to provide a pile guide for aligning a pile with the surface of a substrate into which the pile is to be driven and to provide stability for a piling hammer. Particularly when piling underwater, there is the problem that after the pile has been introduced into the seabed or the like, the guide must be removed to allow the pile to be driven into its final position, which removal is time consuming and thus expensive.

The pile guide in WO 99/11872 comprises a base frame and a pile guide member in turn comprising two parts, each of which is pivotally mounted on the base frame. In this way, each of the two parts is moveable relative to the base frame between an operative position and an inoperative position by rotation about a respective pivot axis. The two parts are held in the operative positions by a latch mechanism, and counterweights are provided to urge the parts into their inoperative positions when the latch mechanism is released. With such a pile guide, it is possible to drive piles fully into a substrate without having to interrupt piling to move the pile guide away from the pile once it has been introduced into the substrate, simply by releasing the latch mechanism and allowing the parts of the pile guide to rotate in their inoperative positions and thus provide sufficient clearance for the hammer.

Pile guides are closed again by pulling the guide parts, e.g. sleeve halves, up by means of rigging connected to an offshore crane. It is important that the sleeves reach the operative position at substantially the same time, as the latches and associated mechanisms must align properly to be able to lock. However, long crane wires, strong currents and/or low visibility, frequently complicate sufficiently accurate timing.

SUMMARY

A pile guide includes a mechanism that couples the guide parts such that movement of a guide part towards the operative position results in movement of at least one other guide part towards the operative position. In an embodiment, the mechanism couples the guide parts such that movement of a guide part towards the operative position results in a corresponding movement by at least one other guide part, preferably all guide parts.

Thus, the guide parts are forced to move together. E.g., if one guide part is pulled towards the closed position, e.g. by a lift rigging of a crane, the other guide part (in case of a total of two guide parts) or at least one other guide part (in case of more than two guide parts) is moved by the mechanism to the same positon relative to the base frame, in case of hinging guide parts e.g. rotated over the same or substantially the same angle.

In an embodiment, to enable proper alignment of the guide parts, in particular of e.g. latches or alignment elements (plates, pins) on the guide parts for maintaining or supporting the closed position, the mechanism couples the guide parts such that if one part is in the operative position, at least one other guide part, preferably all guide parts, is respectively are in the operative position.

In another embodiment, the mechanism comprises at least two hydraulic cylinders, in particular passive hydraulic cylinders, each connected to a guide part and supported by the base frame, e.g. via a mount on the base frame. In a refinement, the hydraulic cylinders are coupled via hydraulic lines, such that hydraulic fluid expelled from one cylinder is fed to at least one other cylinder. In an example, the extended position of the cylinders corresponds to the operative (closed) position of the guide parts and the retracted position of the cylinders corresponds to the inoperative (open) position of the guide parts. In another refinement, providing a compact yet robust mechanism to force the guide parts to move together, each of the hydraulic cylinders is located between a guide part and the base frame and the sides of the cylinders nearest the guide parts are connected, via hydraulic lines, to the side nearest the base frame of another cylinder. Thus, movement imposed on a first guide part generates hydraulic flow resulting in a corresponding movement of a further guide part or parts.

In an embodiment, the hydraulic cylinders are of equal capacity, i.e. an equal amount of hydraulic fluid exiting or entering the hydraulic cylinders results in equal displacement of the pistons and piston rods in the hydraulic cylinders.

In a further embodiment, one or more hydraulic valves, e.g. ball valves, are provided in the hydraulic lines between the cylinders, the valves having a closed position preventing flow of hydraulic fluid between the cylinders and an open position allowing flow of hydraulic fluid between the cylinders. In a refinement, a hydraulic override, e.g. a so-called hot stab connection, is provided to control the hydraulic cylinders independently when the valves are in the closed position. In another refinement, the valves provide a further position, wherein the hydraulic cylinders function as dampers, e.g. by directing flow from one end of a cylinder, preferably of each of the cylinders individually, to the other end of that cylinder (no flow between the cylinders).

In an embodiment, each guide part comprises a latch and a latch counterpart and, in the operative position, the latches and latch counterparts are aligned and locked.

It is generally preferred that the guide member comprises at least two guide parts, preferably has precisely two guide parts, together forming, in the operative position, a hollow member for enclosing the pile during pile driving. In an embodiment, the hollow member has a circular cross-section.

BRIEF DESCRIPTION OF THE DRAWINGS

Aspects of the invention will now be explained in more detail with reference to the Figures, which show a preferred embodiment of a pile guide frame.

DETAILED DESCRIPTION

It is noted that the Figures are schematic in nature and that details, which are not necessary for understanding the present invention, may have been omitted.

Figure 1:
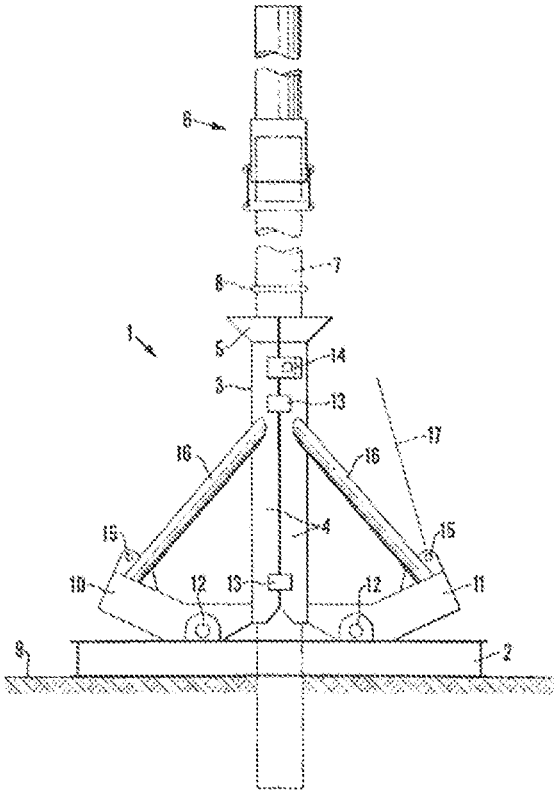
FIGS. 1 and 2 are side views of a pile guide with its guide member in the operative and inoperative positions, respectively.
Figure 2:
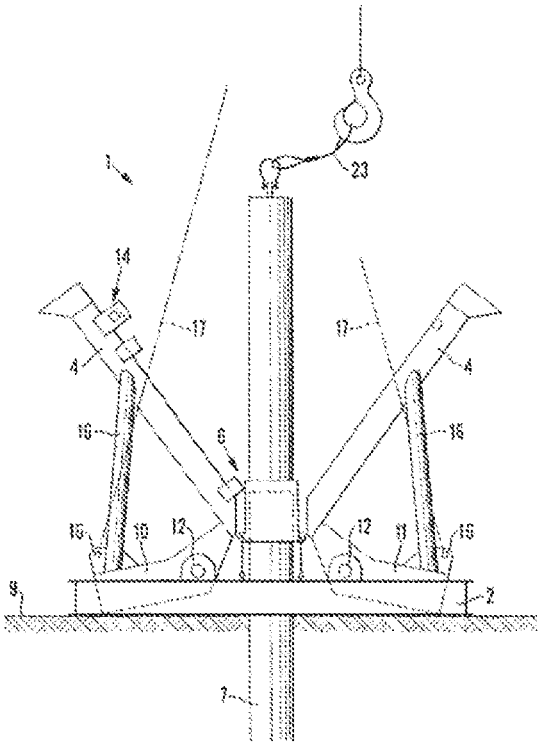

FIGS. 1 and 2 show a pile guide 1 comprising a base frame 2 resting on, in this example, a seabed 9. The base frame 2 has a substantially rectangular footprint made up of so-called mud mats with a centrally placed aperture through which a pile 7 can be guided. The pile guide 1 comprises an open-ended generally vertical tubular guide member 3 supported on the base frame 2 and adapted to slidingly receive a pile 7 to be driven into the seabed 9 by means of a hammer 6 connected to a rigging 23, see FIG. 2. The upper end 5 of the guide member 3 is flared outwardly to form a guide cone to facilitate entry of a pile 7 into the guide member.

The tubular guide member 3 comprises two similar semi-cylindrical guide parts or sleeve halves 4, which are moveable between the operative or closed position shown in FIG. 1 and the inoperative or open position shown in FIG. 2. In the operative positon (FIG. 1), the sleeve halves 4 are held together and aligned by a latch 14 and by alignment plates 13. The respective sleeve halves 4 are mounted on counterweighted arms 10, 11 which are pivoted, via hinges 12, on the base frame 2 such that the arms 10, 11 and thus the sleeve halves are biased under gravity into the inoperative (open) position shown in FIG. 2.

In the example shown in FIGS. 1 and 2, braces 16 connect the outer ends of the arms 10, 11 and upper portions of the parts 4 in the interests of rigidity. Each latch 14 is disengaged automatically by downward movement of the pile 7 as it is driven into the seabed 9. E.g., the pile is provided with a latch trigger or detent 8 which engages a latch plate which is rotated by continued downward movement of the trigger 8 to push the plate outwardly so that the latch is released. The sleeve halves 4 then fall under gravity into the position shown in FIG. 2. In this way, it is possible to continue driving the pile into the seabed without the need for removing the pile guide or the hammer from the pile, since the two sleeve halves 4 of the guide are moved clear of the pile and the driving hammer 6.

The pile guide is moved back into its working condition by operation of slings or cables 17 arranged to lift the pile guide, the slings 17 being connected to lifting eyes 15 on the outer ends of the arms 10, 11. During driving the slings 17 are slack to allow the frame 2 to sit fully on the seabed.

Figure 3:
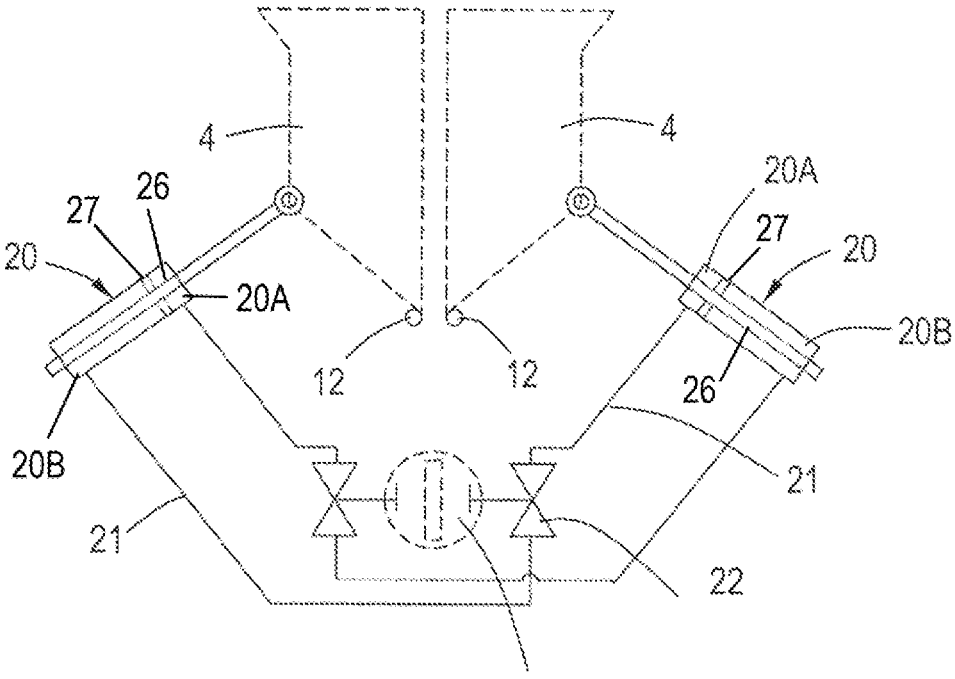
FIG. 3 is a schematic representation of a mechanism coupling the movement of the guide parts of the guide member.

FIG. 3 schematically shows a hydraulic mechanism installed in a pile guide and comprising two hydraulic cylinders 20 of equal capacity, each with its upper end connected to one of the sleeve halves 4 and with it lower end supported by the base frame 2. The hydraulic cylinders are coupled via hydraulic lines 21, such that hydraulic fluid expelled from one cylinder is fed to the other cylinder. In this example, the upper sides 20A of the cylinders 20 nearest the guide parts 4 are connected, via hydraulic lines 21, to the lower sides 20B of the cylinders 20 nearest the base frame.

Thus, if one guide part is pulled harder than the other, hydraulic fluid is expelled from the upper portion 20A of the cylinder 20 connected to that guide part 4 is expelled from the cylinder 20 and fed to the lower side 20B of the other cylinder 20, thus forcing the piston rod 26 having piston 27 of that cylinder 20 and the guide part 4 connected to that cylinder 20 up at a substantially equal rate and over a substantially equal (rotational) distance. As a result, the guide parts 4 reach the operative position simultaneously and the latches align and lock inherently.

In this example, the hydraulic mechanism comprises a hydraulic ball valve 22 in each of the hydraulic lines 21, which valves are configured to be operated by a remotely operated vehicle (ROV), e.g. are provided with a so-called bucket WROV tap 23. The valves have a closed position preventing flow of hydraulic fluid between the cylinders and an open position allowing flow of hydraulic fluid between the cylinders.

The invention is not restricted to the embodiment described above and can be varied in numerous ways within the scope of the claims. E.g., in another example, the guide member comprises three of four hinging guide parts and the passive hydraulic cylinders are connected in series, i.e. movement imposed on a first guide part generates hydraulic flow resulting on a corresponding movement of a second guide part, which in turn generates hydraulic flow resulting on a corresponding movement of a third guide part. In yet another example, the guide parts are coupled via gears or via a chain or cable and chain wheels or pulleys, respectively, to positively couple the guide parts such that movement of one guide part towards the operative position results in an equal movement the other guide part(s) and in the guide parts arriving at the operative position simultaneously.

The invention claimed is:

1. A pile guide comprising a base frame and a guide member configured to guide a pile as it is driven into a substrate, the guide member comprising a plurality of guide parts that are movable between an operative position wherein portions of the guide parts are positioned proximate an outer surface of the pile simultaneously at different radial and axial locations with respect to the outer surface to support the pile during driving the pile into the substrate and an inoperative position, and a passive mechanism interconnecting the guide parts such that movement of a guide part towards the operative position operates the passive mechanism that moves at least one other guide part towards the operative position.

2. A method for supporting a pile to be driven in a substrate, comprising providing a pile guide having a base frame and a guide member having two guide parts that are each movable between an operative position where the guide parts are positioned proximate each other to support the pile for guided driving and an inoperative position wherein the guide parts are displaced from each other, the guide parts being coupled to each other via a mechanism wherein movement of one of the guide parts towards its operative position operates the mechanism such that the operation of the mechanism causes movement of the other guide part towards its operative position; and moving at least one of the guide parts toward its operative position so as to thereby operate the mechanism and thereby cause movement of the other guide part towards its operative position.

3. The method of claim 2 wherein moving comprises moving the at least one of the guide parts causes guide parts to arrive at their respective operative positions simultaneously.

4. The method of claim 2 wherein the mechanism comprises a first hydraulic cylinder coupling a first guide part of the two guide parts to the base frame and a second hydraulic cylinder coupling a second guide part of the two guide parts to the base frame, the first hydraulic cylinder and the second hydraulic cylinder being hydraulically interconnected wherein movement of one of the guide parts causes movement of the other guide part.

5. The method of claim 4 and further comprising controlling hydraulic flow between the first and second hydraulic cylinders from a first state where hydraulic flow exists between the first and second hydraulic cylinders and a second state where no flow exists between the first and second hydraulic cylinders.

6. A pile guide comprising:

a base frame;

a guide member supported by the base frame and configured to guide a pile as the pile is driven into a substrate, the guide member comprising a first guide part and a second guide part, each guide part movable between an operative position configured to support the pile during driving the pile into the substrate and an inoperative position;

a first actuator drivingly coupled to the first guide part; and a second actuator drivingly coupled to the second guide part, and wherein the second actuator is drivingly coupled to the first actuator such that movement of the second guide part towards its operative position operates the second actuator to drive the first actuator and move the first guide part to its operative position.

7. The pile guide according to claim 6, wherein a mechanism couples the first and second actuators such that movement of the first guide part towards the operative position results in a corresponding movement by the second guide part.

8. The pile guide according to claim 6, wherein a mechanism couples the first and second actuators such that if the first guide part is in the operative position, the second guide part is respectively in the operative position.

9. The pile guide according to claim 6, wherein each guide part comprises a latch and a latch counterpart and wherein, in the operative position, the latches and latch counterparts are aligned and locked.

10. The pile guide according to claim 6, wherein the first and second guide parts together form, in the operative position, a hollow member configured to enclose the pile during pile driving.

11. The pile guide according to claim 10, wherein the hollow member defines a circular lumen.

12. The pile guide according to claim 6, wherein the first and second guide parts are mounted on the base frame via hinges.

13. The pile guide according to claim 6, wherein the first and second guide parts are all the guide parts.

14. The pile guide of claim 6 wherein the first actuator comprises a first hydraulic cylinder and the second actuator comprises a second hydraulic cylinder, the second hydraulic cylinder connected to the first hydraulic cylinder to hydraulically drive first hydraulic cylinder.

15. The pile guide according to claim 14, wherein the first and second hydraulic cylinders are coupled via hydraulic lines, such that hydraulic fluid expelled from one of the first and second hydraulic cylinders is fed to the other of the first and second hydraulic cylinders.

16. The pile guide according to claim 15, comprising one or more hydraulic valves in the hydraulic lines between the first and second hydraulic cylinders, the one or more hydraulic valves having a closed position preventing flow of hydraulic fluid between the first and second hydraulic cylinders and an open position allowing flow of hydraulic fluid between the first and second hydraulic cylinders.

17. The pile guide according to claim 14, wherein each of the first and second hydraulic cylinders is located between its associated guide part and the base frame, and each of the first and second hydraulic cylinders has a piston and cylinder sides on either side of the piston, and wherein the sides of the first and second hydraulic cylinders nearest the associated guide parts are connected, via hydraulic lines, to sides of the first and second hydraulic cylinders nearest the base frame.

18. The pile guide according to claim 14, wherein the first and second hydraulic cylinders are of equal capacity.

19. A method for supporting a pile to be driven in a substrate, comprising providing a base frame, a guide member supported by the base frame and configured to guide the pile as the pile is driven into the substrate, the guide member comprising a first guide part and a second guide part, each guide part movable between an operative position configured to support the pile during driving the pile into the substrate and an inoperative position, a first actuator drivingly coupled to the first guide part, a second actuator drivingly coupled to the second guide part, wherein the second actuator is drivingly coupled to the first actuator; and moving the second guide part toward its operative position which operates the second actuator that in turn drives the first actuator so to move the first guide part to its operative position.

20. The method of claim 19 wherein the first actuator comprises a first hydraulic cylinder and the second actuator comprises a second hydraulic cylinder, and wherein the second hydraulic cylinder hydraulically drives first hydraulic cylinder.

* * * * *